United States Patent [19]

Heyl et al.

[11] Patent Number: 4,543,876

[45] Date of Patent: Oct. 1, 1985

[54] AXIAL PISTON MACHINE HAVING ADJUSTABLE HYDROSTATICALLY SUPPORTED SWASHPLATE

[75] Inventors: Walter Heyl, Johannesberg; Thomas Loffler, Waldaschaff, both of Fed. Rep. of Germany

[73] Assignee: Linde Aktiengesellschaft, Wiesbaden, Fed. Rep. of Germany

[21] Appl. No.: 573,948

[22] Filed: Jan. 26, 1984

[30] Foreign Application Priority Data

Jan. 27, 1983 [DE] Fed. Rep. of Germany ..... 3302763

[51] Int. Cl.[4] ..... F01B 13/04; F04B 1/26

[52] U.S. Cl. ..... 91/506; 417/222; 92/12.2

[58] Field of Search ..... 91/472, 486–488, 91/499, 504–507; 92/12.2; 417/217, 222

[56] References Cited

U.S. PATENT DOCUMENTS

| | | | |
|---|---|---|---|
| 2,455,330 | 11/1948 | Denison, Jr. | 91/486 |
| 2,871,798 | 2/1959 | Thoma | 91/505 X |
| 3,682,044 | 8/1972 | Ankeny et al. | 91/506 X |
| 3,828,400 | 8/1974 | Mason et al. | 91/497 |
| 3,967,541 | 7/1976 | Born et al. | 91/506 X |
| 4,142,452 | 3/1979 | Forster et al. | 91/506 |
| 4,189,921 | 2/1980 | Knapp | 60/452 X |
| 4,449,444 | 5/1984 | Forster | 417/222 X |

FOREIGN PATENT DOCUMENTS

| | | | |
|---|---|---|---|
| 809629 | 8/1951 | Fed. Rep. of Germany | 92/12.2 |
| 2100028 | 10/1971 | Fed. Rep. of Germany | 91/486 |
| 2101078 | 8/1972 | Fed. Rep. of Germany | 91/488 |
| 136285 | 6/1979 | German Democratic Rep. | 91/486 |
| 149399 | 7/1981 | German Democratic Rep. | 91/506 |
| 791992 | 3/1958 | United Kingdom | 91/499 |
| 1508265 | 4/1978 | United Kingdom | 91/499 |

*Primary Examiner*—William L. Freeh
*Assistant Examiner*—Paul F. Neils
*Attorney, Agent, or Firm*—Buell, Ziesenheim, Beck & Alstadt

[57] ABSTRACT

An adjustable axial piston machine in swashplate construction, preferably an axial piston pump, is provided in which the rocker body is supported with a semicylindrical surface by a friction bearing in a hollow semicylindrical surface and pressure pockets loaded with pressure medium are provided for hydrostatic relief of the bearing pressures in the bearing surfaces, in which case in a machine in which each of the two connections that can be loaded with feed pressure, a pressure pocket is provided on each side of the rocker body, where the pressure pocket that lies on the side on which the working pistons loaded with feed pressure also move is loaded with feed pressure.

10 Claims, 16 Drawing Figures

AXIAL PISTON MACHINE HAVING ADJUSTABLE HYDROSTATICALLY SUPPORTED SWASHPLATE

This invention relates to axial piston machines of swashplate form and particularly to axial piston pumps or motors of swashplate form in which the piston support surface or swashplate is formed in a semi-cylindrical rocker body, whose cylindrical surface is supported in friction bearings in a hollow-cylindrical bearing box, where a pressure pocket is provided, which is connected with a source of pressure medium, in which case the axial piston machine has two connections, namely, a feed line connection and a low-pressure line connection, and the pressure pocket connected with the pressure-medium source is located on the side of the rocker body on which the working pistons loaded with feed pressure are supported, as disclosed in our copending application.

In axial piston machines it is familiar practice to support the rocker body in a sliding bearing, which has pressure pockets for the purpose of hydrostatic release in at least one of the two bodies capable of sliding relative to each other. In a familiar embodiment pressure medium is fed from the high-pressure channel of the axial piston machine to the pressure pockets located in the bearing body through tubes or channels in the housing lying outside of the axial piston machine. In another familiar embodiment or design the pressure medium is fed to the pressure pockets through the piston, a borehole and the pressure cushion in the slide shoe and boreholes in the rocker from the cylinder space. For this purpose, boreholes are provided in the rocker body that empty in the swashplate in the zones of it that are swept by the pressure cushions of the slide shoes. Because the slide shoes leave an interspace between them, the borehole empties into the inner space of the axial piston machine if there is no slide shoe in front of the borehole mouth, such that the pressure pocket is relieved of pressure during these periods. This leads to an irregular vibration-like loading of the pressure pockets and a correspondingly disturbed structure of the lubrication film between the rocker body and the bearing surface, especially at low r.p.m.'s, and to an increased oil loss. There is also the danger that the dirt present in the bearing pocket can pass through the boreholes in the rocker body under the slide shoe and result in increased wear there. In addition, a back suction from the pressure pockets and thus cavitation can occur (DE-OS No. 22 54 809).

In contrast, the invention is based on a modification of the solution according to our copending application. The solution disclosed in our copending application is applicable, however, only for axial piston machines, preferably axial piston pumps, in which the same channel in the control mirror is always the channel carrying the high pressure, i.e., the cylinders of the cylinder drum located on a certain spatial side relative to the axial piston machine are always loaded with high pressure.

The invention proposes to design the support relationships as favorably as possible and with the lowest possible production cost through hydrostatic bearing relief in a machine in which one of two connections can selectively be the feed line connection and the other can be the low-pressure line connection, which is thus suited for closed circuit in both feed directions.

The task outlined above is resolved in this invention by providing a feed line connection and a low pressure connection, each of which can be operated as a feed line connection and where, in the operating condition, the other of the two connections is the low-pressure line connection and by providing two pressure pockets of which the one that is located on the side of the rocker body on which the working pistons loaded with feed pressure are supported is connected with the source of pressure medium, in which case the pressure medium source is the feed pressure line. That is to say, the object of the invention of our copending application is utilized twice in the axial piston machine according to the present invention, once on each side, such that regardless of which of the two connections of the axial piston machine is the feed line connection, a pressure pocket loaded by the feed line pressure is always located on the side on which the control channel loaded by the feed line pressure lies, also in the rocker body bearing support. That is, a pressure pocket is provided on each side of the rocker body, only one of which is loaded with the feed line pressure, namely, the one on the side of the rocker body on which the working pistons loaded with feed pressure are supported.

The "side" of the axial piston machine is understood here to be a side going out from the plane passing through the rotation axis of the cylinder drum that is normal to the swivel axis of the rocker body.

The support forces that are caused by the working pistons supported on the swashplate are the only ones compensated by these pressure pockets.

In axial piston machines with at least one servo piston supported against the rocker body on one side of the swivel axis and positioned at least approximately parallel to the working pistons and a counter-force generator supported against the rocker body on the other side of the swivel axis, e.g., a spring or preferably a second piston, forces also arise through this servo piston and the counterforce generator that act on the rocker body parallel to the forces of the working pistons. In order to support these additional forces acting on the bearing surface also, additional pressure pockets are provided which are acted upon by a pressure proportional to the pressure acting on the servo piston and are located on the side of the rocker body on which the servo piston and/or the counteracting force generator is supported against the rocker body. The axial force produced by the working pistons supported with low pressure against the piston support surface is compensated by means of the additional pressure pockets located on the side on which the working pistons are acted upon with the low pressure in the cylinder drum, if this does not occur through the principal pressure pocket loaded with low pressure.

In an axial piston machine in which the servo piston is supported on one side and the counterforce generator on the other side of the plane passing through the rotation axis of the cylinder drum and normal to the swivel axis against the rocker body, it is provided in accordance with another step of the invention that an additional pressure pocket is located on each side of the said plane. However, while only one of the two principal pressure pockets is acted upon by feed pressure according to claim 1 and the other is relieved of pressure or connected with the low pressure, in the various embodiments of the object of invention with two additional pressure pockets they are always acted upon by the pressure assigned to them. However, it is also possible that the additional pressure pocket of one side is connected with the principal pressure pocket of the other side. The additional pressure pcokets can be acted upon by a pressure proportional to the pressure acting on the servo piston. If the counterforce generator is a piston that is always loaded with pressure, the additional pressure pockets can be loaded with the same pressure with which the counterforce generator piston is loaded, e.g., the feed pressure.

On the other hand, if both the servo piston and the counterforce generator are located on the same side of the plane passing through the rotation axis and normal to the swivel axis in another design of the axial piston machine, only one additional pressure pocket will be located on the same side of the said plane also.

The invention facilitates the successful utilization of the solution proposed in principle in this application also if the feed direction is reversed in a closed circuit or if one switches from working operation to braking with the feed direction remaining the same. An optimal control behavior is also facilitated with respect to oscillation, damping, and hysteresis in machines that operate in closed circuit by this type of release. Such a rocker having friction bearings and with hydrostatic release attains a higher service life than a rocker system with roller bearings. A noise damping due to breakdown of the pressure peaks is achieved by the fluid cushion in the gap between the rocker body and the bearing body. A release of the servo piston forces is also achieved, even when there is a change in the pressure sides.

In the foregoing general description of our invention we have set out certain objects, purposes and advantages of the invention. Other objects, purposes and advantages of the invention will be apparent from a consideration of the following description and the accompanying drawings in which.

Figure 1:
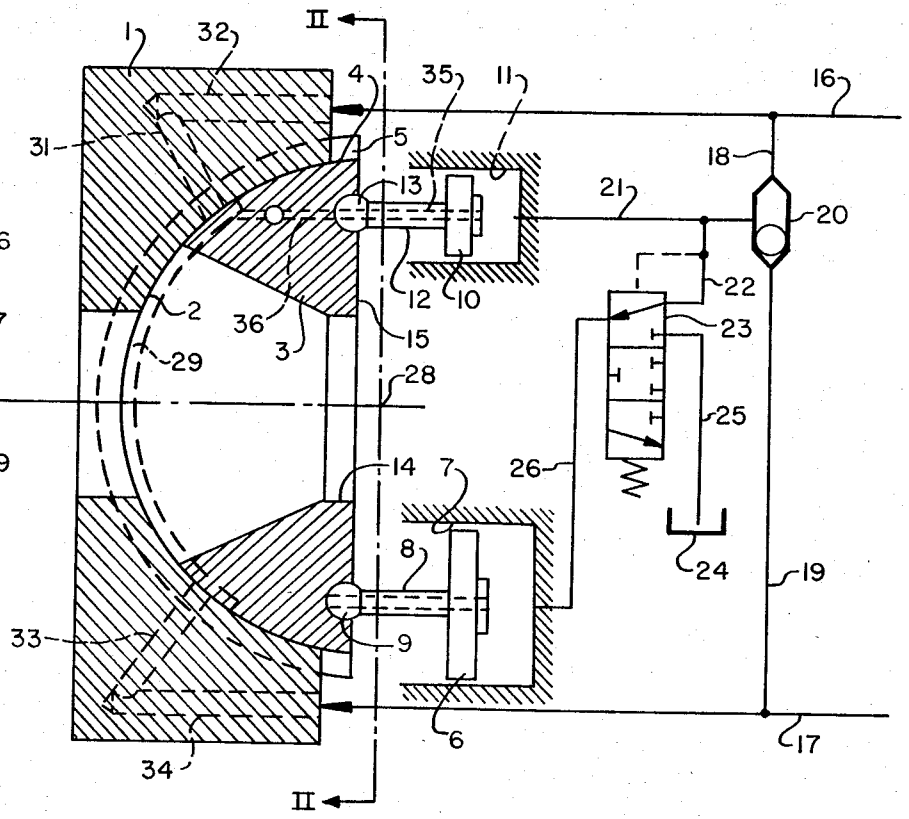
FIG. 1 shows a side view semischematically, partly in cross section.

Referring to the drawings and particularly to FIG. 1, the bearing body 1 has a hollow-cylindrical surface 2 in which the rocker body 3 is supported with its cylindrical surface 4, where it is supported against lateral displacement by the edges 5.

The rocker body 3 is thus capable of swivelling in the bearing surface 2. The servo piston 6 effects the swivelling; it is capable of sliding in an operating cylinder 7 and its piston rod 8 is supported against the rocker body 3 by means of a ball head 9. A counterforce is produced by a counterforce generator piston 10, which is capable of sliding in a counterforce generator cylinder 11 and has a piston rod 12, which is also supported against the rocker body 3 by means of a ball head 13. The servo piston 6 has a considerably larger surface than the counterforce generating piston 10.

The rocker body 3 has a central borehole 14, through which the shaft (not shown in the drawing) passes. A piston guide surface (swashplate) 15 is formed on the rocker body 3. The pistons supported against this swashplate 15 and the cylinder drum and the control body, against which the cylinder drum lies, are not shown in the drawing. Two channels are formed in this control body, one of which is the feed pressure channel and the other is the low-pressure channel, depending on the operating state. One of the two lines 16 and 17 is connected to each of these two channels. A branch line 18 branches out from line 16 and a branch line 19 branches off from line 17. The two branch lines 18 and 19 lead to a reversing valve 20, which connects the one of the two branch lines 18 and 19 carrying the higher pressure and thus the one of the two lines 16 and 17 carrying the higher pressure with the line 21. The counterforce generator cylinder 11 is always connected on the one hand to the line 21 and a 3-connection/3-position multiway valve 23 is also connected through a line 22. A line 25 leading to a reservoir 24 is connected to its second connection and the line 26, which leads to the operating cylinder 7, is connected to its third connection. If the valve 23 is in the closed position, the operating chamber in the servo piston 7 is thus closed off and the pressure fluid is impounded in it, while the counterforce generating piston 10 is acted upon by pressure and thus holds the rocker body 3 under tension. If the valve 23 is in the position in which it connects the lines 22 and 26 with each other, the pressure present in line 21 is conveyed through line 26 into the operating cylinder 7. Because the servo piston 6 has a greater surface than the counterforce generating piston 10, which is acted upon by the same pressure, the servo piston is shifted to the left in FIG. 1 and displaces the rocker body clockwise, with the result that it displaces the counterforce generating piston 10 to the right in the drawing. On the other hand, if the multiway valve 23 is in the position in which it connects the lines 25 and 26 with each other, pressure medium is allowed to flow out of the operating cylinder 7 so that the counterforce generating piston 10 loaded with pressure displaces the rocker body in a counterclockwise direction. The valve 23 is depicted in the implementation example as a valve controlled by the feed pressure, thus exerting a "pressure cutoff function".

Figure 2:
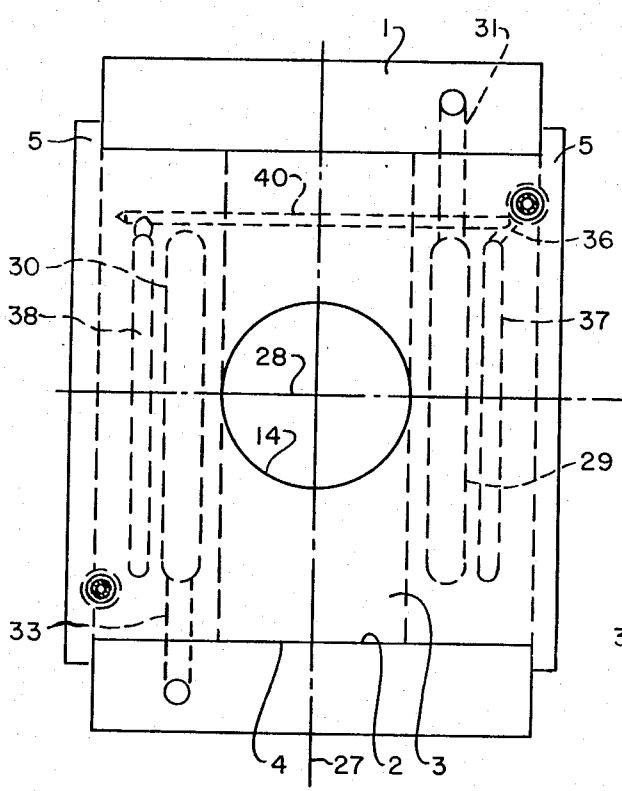
FIG. 2 shows a cross sectional view on the line II—II according to FIG. 1.

If the channel in the control bottom, which is connected with the line 16, is the feed pressure channel and, correspondingly, the channel in the control bottom, which is connected with line 17, is the low-pressure channel, the working pistons in the cylindrical drum, which are located in FIG. 2 on the right-hand side of the plane 27 and are not shown in the drawing, are acted upon with feed pressure.

The hollow-cylindrical bearing surface 2 and accordingly the cylindrical bearing surface 4 are arranged coaxially to the swivel axis 28, around which the rocker body 3 swivels.

A pressure pocket 29 and a second pressure pocket 30 are formed in the rocker body 3. The pressure pocket 29 is connected with the line 16 through a borehole 31 and a second borehole 32 The pressure pocket 30 is connected with the line 17 through a borehole 33 and a borehole 34.

Consequently, if the line 16 is the feed pressure line and accordingly the working pistons acted upon by the feed pressure are supported on the right-hand side of the plane 27 in FIG. 2, the pressure pocket 29, which is also located on the right-hand side of the plane 27 in FIG. 2 is loaded with pressure through the line 16 and the boreholes 32 and 31 and consequently there is a release from the forces induced by the working pistons on the right side of the rocker body 3.

In this case the line 17 is connected with the low-pressure channel and consequently the pistons supported on the left-hand side of the plane 27 in FIG. 2 are acted upon by low pressure. Accordingly, the pressure pocket 30 located on the left-hand side of the plane 27 in FIG. 2 is acted upon by low pressure through the boreholes 33 and 34 and the line 17.

On the other hand, if the line 17 is loaded with feed pressure, the pressure pocket 30 is also loaded with feed pressure and the working pistons located on the left-hand side of the plane 27 in FIG. 2 are also loaded with feed pressure, so that again the pressure pocket lies on the same side and produces a counterforce on the same side as the working pistons that are acted upon by feed pressure.

The servo piston 6 and the counterforce generating piston 10 also produce axial forces that act on the rocker body 3. In order to compensate these also, the piston rod 12 of the counterforce generating piston 10 is provided with a borehole 35 that communicates with a borehole 36 in the rocker body 3 and is connected with a pressure pocket 37 that is arranged parallel to the pressure pocket 29. On the other side of the plane 27 a pressure pocket 38 is arranged in an analogous manner parallel to the pressure pocket 30; it is connected through a transverse borehole 40 with the borehole 36. The two additional pressure pockets 37 and 38 are thus continuously acted upon with the pressure that also acts on the counterforce generating piston 10. The servo piston 6 (not detectable in the drawing) is located on the left-hand side of plane 27 in FIG. 2. The higher pressure present in the two lines 16 and 17 thus acts continuously on the counterforce generating piston 10 on the one hand, and in the two additional pressure pockets 37 and 38 on the other. The two additional pressure pockets 37 and 38 are thus located on both sides of the plane 27 because the pistons 10 and 6 are also located on different sides of the plane 27. The additional pressure pockets 37 and 38 are narrower than the pressure pockets 29 and 30, corresponding to the ratio of the piston surface of the counterforce generating piston 10 to the sum of the surfaces of the working pistons located on one side of the plane 27.

Figure 3:
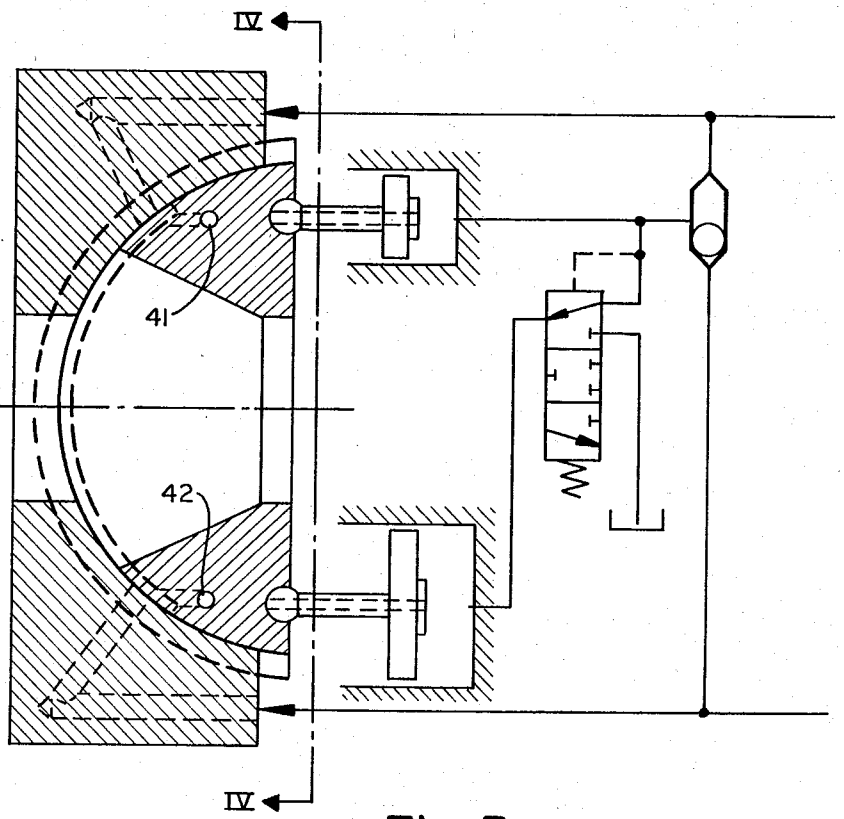
FIG. 3 shows a different design of the connection of the pressure pockets with each other in the same embodiment as FIG. 1.
Figure 4:
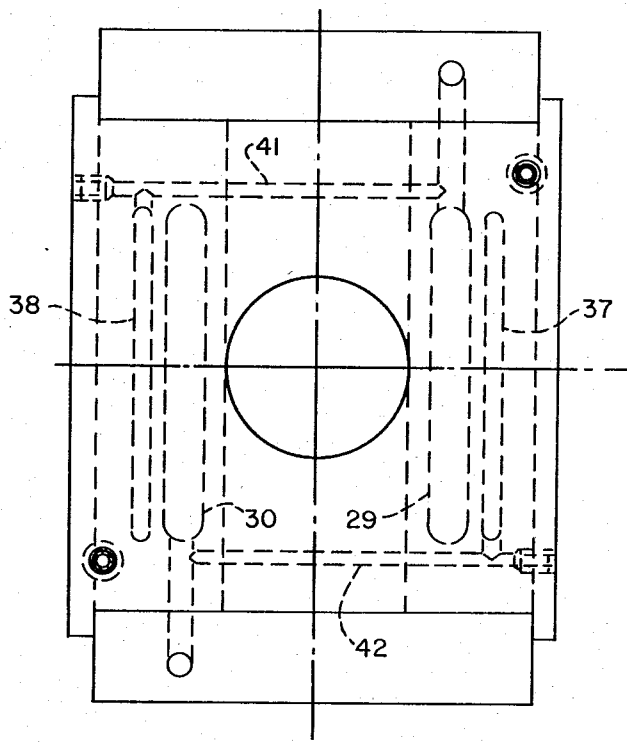
FIG. 4 shows it in the same embodiment as FIG. 2.

The embodiment according to FIGS. 3 and 4 differs from the design according to FIGS. 1 and 2 in that in this case the additional pressure pocket 38 is continuously connected through a transverse borehole 41 with the pressure pocket 29 and the pressure pocket 30 is continuously connected through a transverse borehole 42 with the additional pressure pocket 37.

Figure 5:
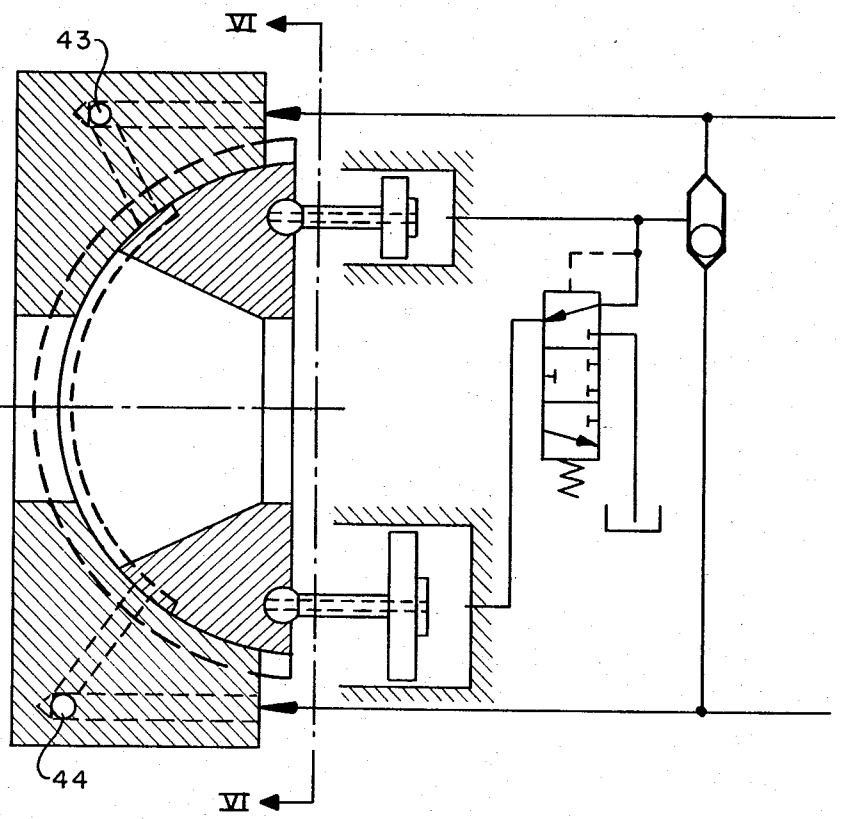
FIGS. 5 and 6 shows a different design, in which the connecting borehole is arranged differently, in a representation analogous to FIGS. 1 and 2.
Figure 6:
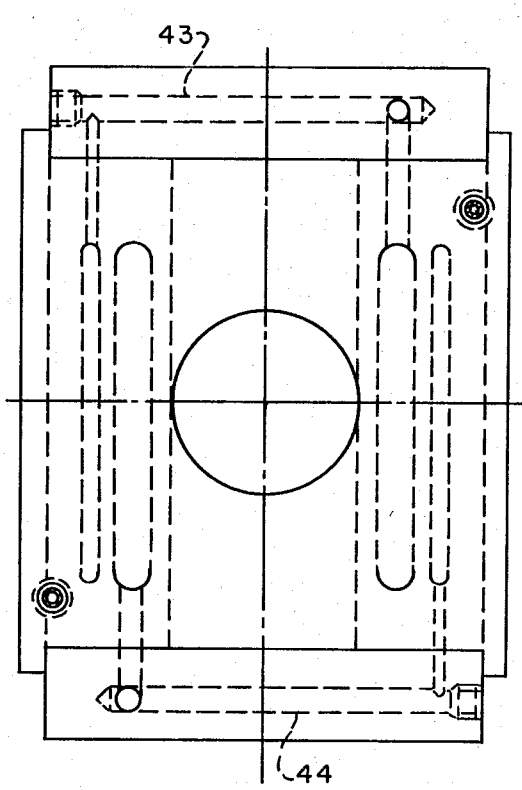

The embodiment adcording to FIGS. 5 and 6 differs from the embodiment according to FIGS. 2 and 3 only in that in this case the connection between the additional pressure pocket 38 and the pressure pocket 29 is produced by the transverse boreholes 43 and it is formed in the bearing body 1 and that accordingly the connection between the pressure pocket 30 and the additional pressure pocket 37 is produced by the transverse borehole 44, which is also located in the bearing body 1.

Figure 7:
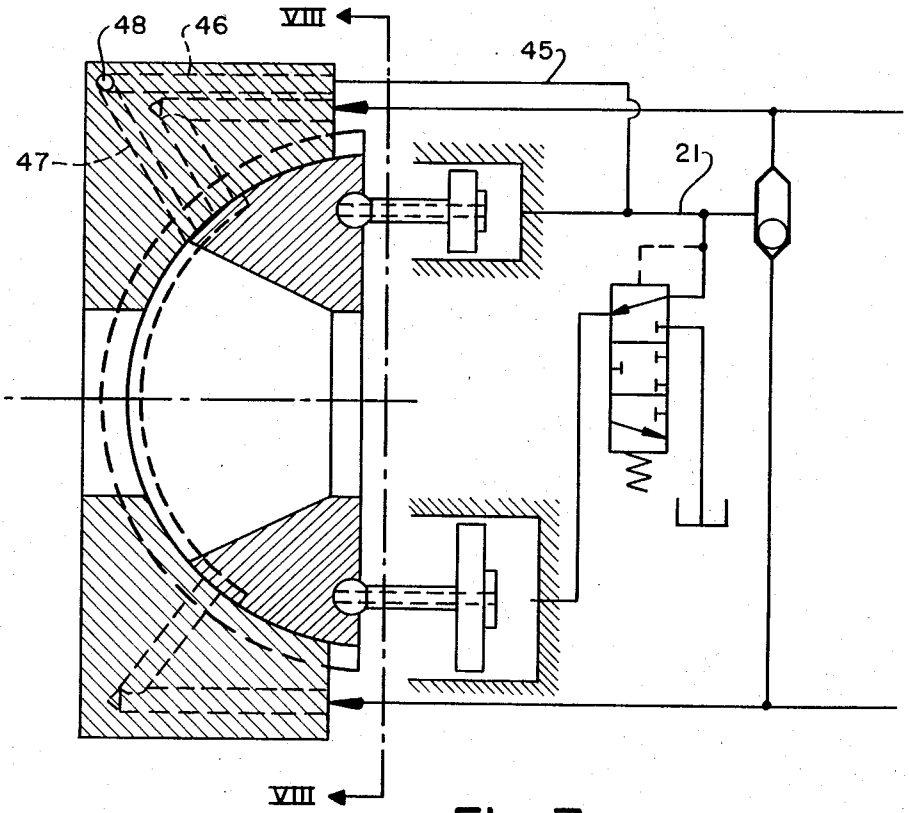
FIG. 7 and 8 show an arrangement in which both additional pockets are always acted upon by high pressure and the connection is located in the bearing box in an analogous representation.
Figure 8:
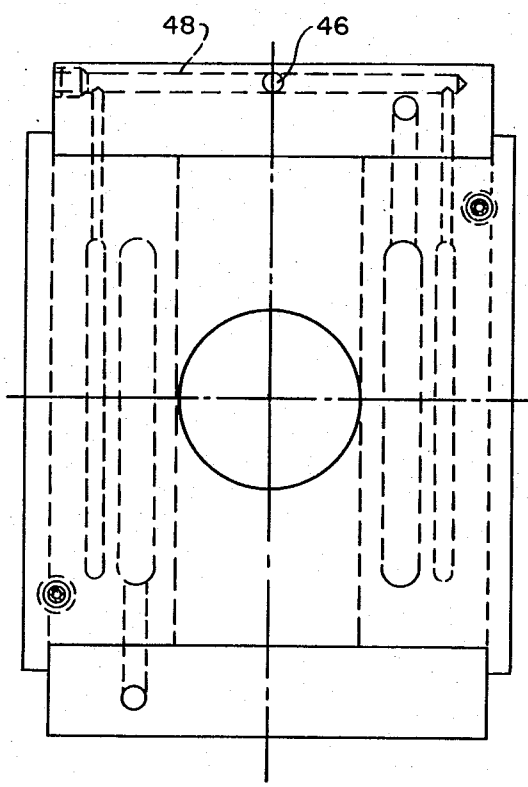

The embodiment according to FIGS. 7 and 8 differs from that of FIG. 1 in that a line 45 branches off of line 21 and it continuously loads the two additional pressure pcokets 37 and 38 with feed pressure through the boreholes 46 and 47, where the transverse borehole 48 is again located in the bearing body 1.

Figure 9:
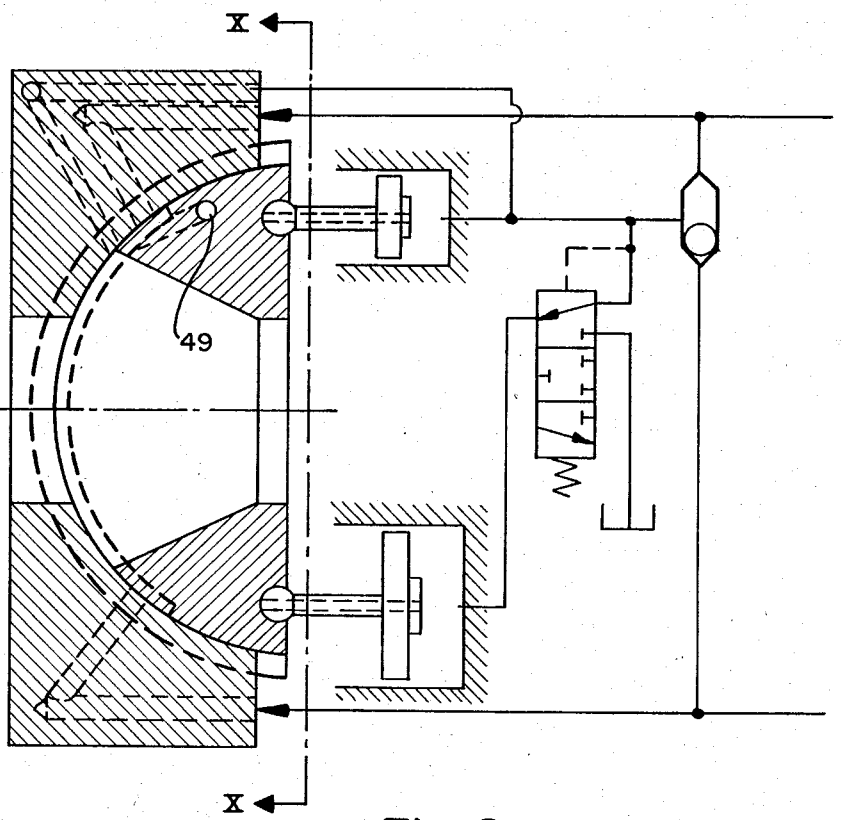
FIGS. 9 and 10 show an arrangement according to the release principle in FIGS. 7 and 8, but with a different arrangement of the connecting borehole.
Figure 10:
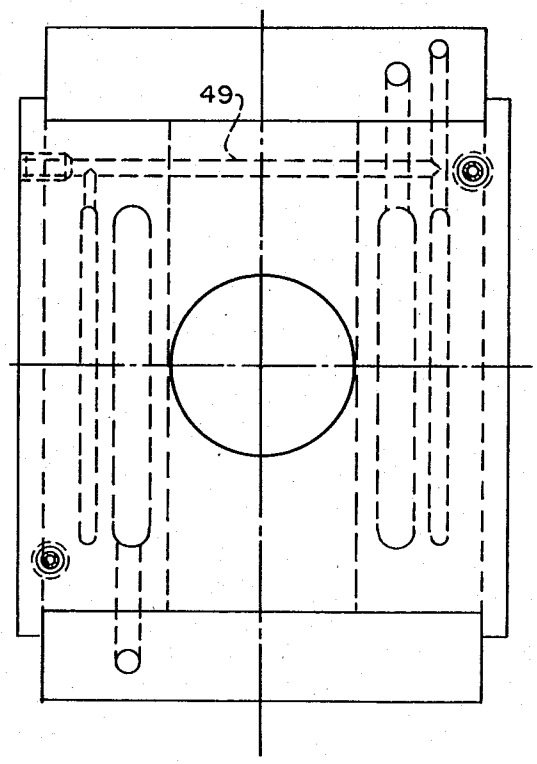

The embodiment according to FIGS. 9 and 10 matches that according to FIGS. 7 and 8, with the exception that the transverse borehole 49 is again located in the rocker body 3.

Figure 11:
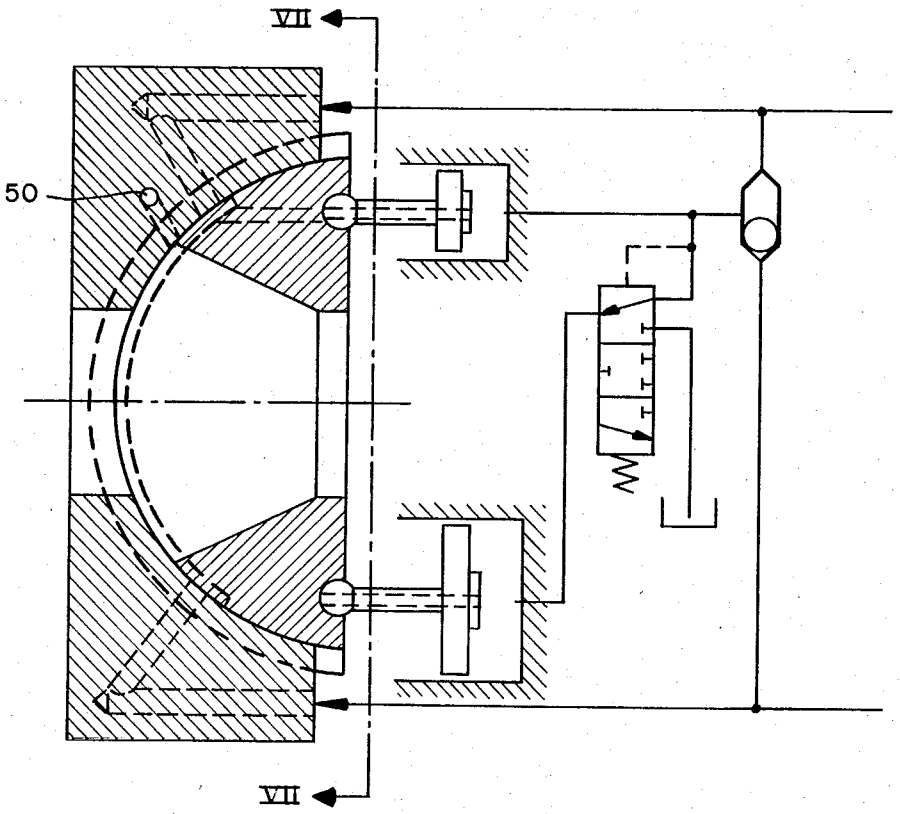
FIGS. 11 and 12 show a different embodiment of the basic principle according to FIGS. 1 and 2 relative to the connecting borehole.
Figure 12:
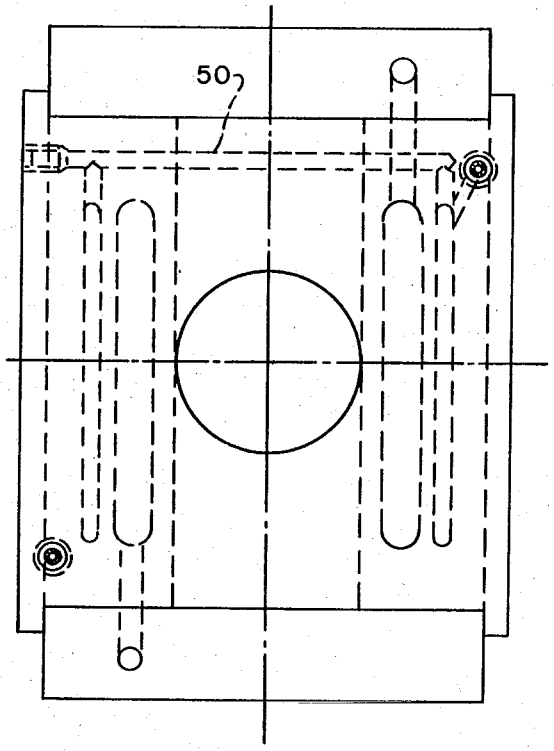

The embodiment according to FIGS. 11 and 12 differs from that according to FIG. 1 in that the transverse borehole 50 that connects the additional pressure pockets 37 and 38 with each other is located in the bearing body 1.

Figure 13:
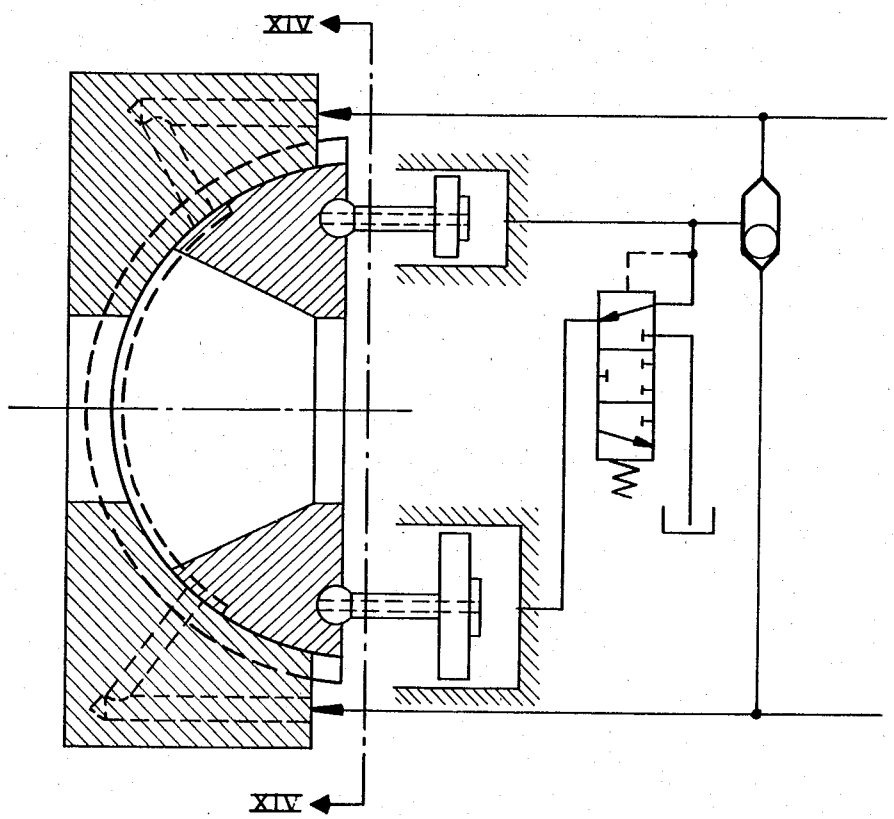
FIGS. 13 and 14 show an embodiment for the case where the servo piston and counterforce generator are located on only one side.
Figure 14:
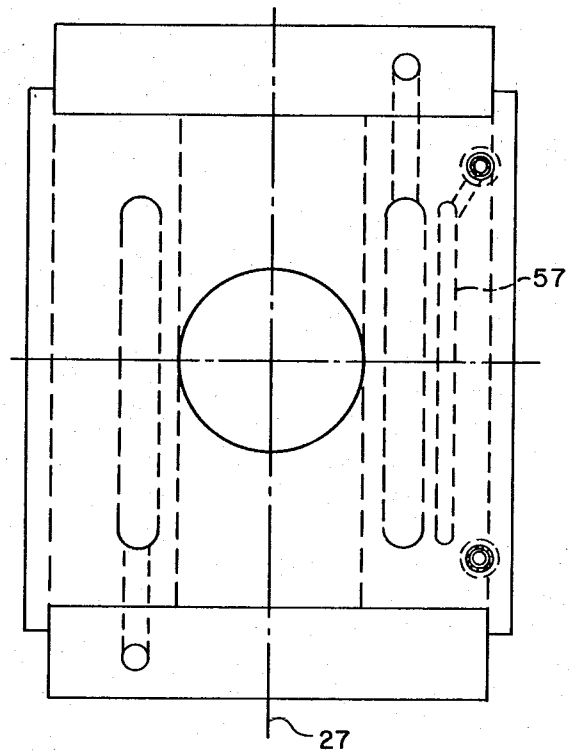

The embodiment according to FIGS. 13 and 14 shows an arrangement in which the operating cylinder 7 and also the counterforce generating cylinder 11 are both located on the right-hand side of the plane 27 in FIGS. 2 or 14. In this case only one additional pressure pocket 57 is provided on this same right-hand side of the plane 27.

Figure 15:
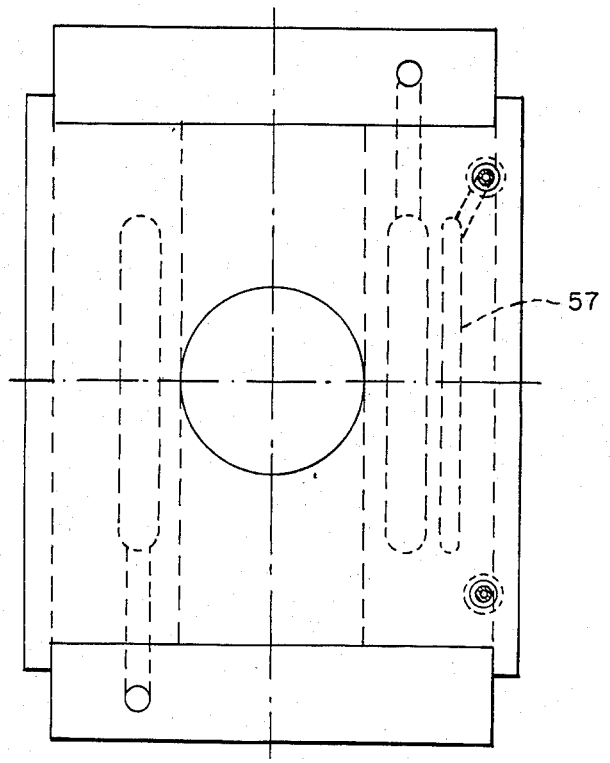
FIG. 15 shows another embodiment of the invention as a modification of FIG. 14.

Other embodiments are also possible. For example, it is possible to locate the servo piston and the counterforce generator on the same side of the plane passing through the axis of rotation and running in the direction of swivelling. This would mean, for example, that the support point for the counterforce generator, detectable at the lower left in FIG. 14 drops out, and is located on the right-hand side as in FIG. 15, preferably symmetric to the position shown in FIG. 14 on the left-hand side.

Figure 16:
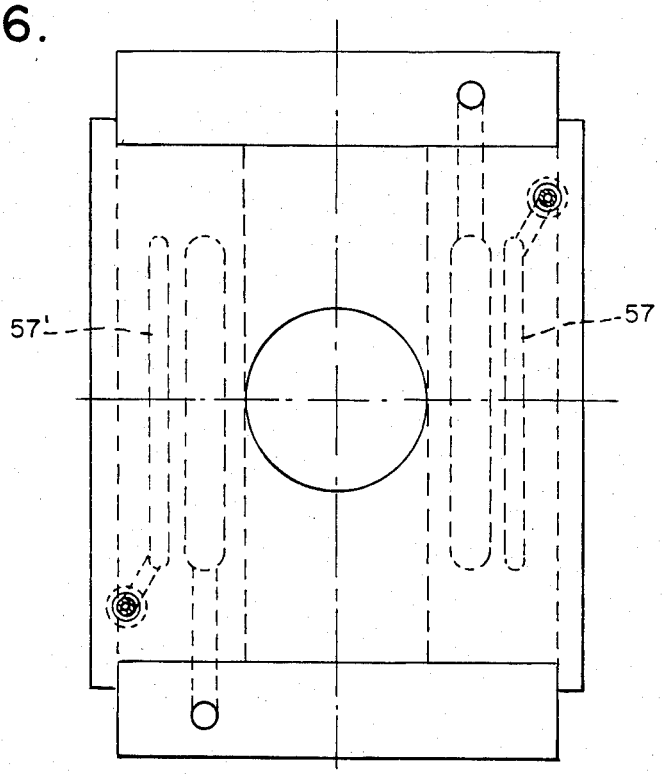
FIG. 16 is still another embodiment of the invention as a further modification of FIG. 14.

In addition, various possible embodiments can be mentioned, in particular, that an additional pressure pocket is provided either only as the generator of a counterforce for the force of the servo piston or merely as the generator of a counterforce for the counterforce generator, or preferably that two additional pressure pockets are provided, one of which is assigned to the servo piston and one to the counterforce generator (that is, preferably an arrangement according to claim 3). That is, in an embodiment according to FIG. 16 a second additional pressure pocket, corresponding to the additional pressure pocket 57 on the right-hand side in the drawing, would be provided on the left-hand side in the drawing, which is connected through a connecting borehole with the support for the counterforce generator, shown at the lower left in FIG. 14.

In the foregoing specification we have set out certain preferred practices and embodiments of our invention, however, it will be understood that this invention may be otherwise embodied within the scope of the following claims.

We claim:

1. In an adjustable axial piston machine of swashplate form, in which the piston support surface or swashplate is formed on a semicylindrical rocker body whose cylindrical surface is supported by friction bearings in a hollow-cylindrical bearing body, a pressure pocket that is connected to a pressure-medium source, and in which the axial piston machine has two connections, including reversible feed line and low-pressure line connections, and the pressure pocket connected with the pressure-medium source is located on the side of the rocker body on which the working piston loaded with feed pressure is supported, the improvement comprising a servo piston on one side of the rocker body for rotating said rocker body in the bearing body, a counterforce generator in the other side of the rocker body, pressure pockets in the form of two channels in one of the bearing body and rocker body, reversing valve means between said reversible feed line and low pressure line connections maintaining feed line pressure on said counterforce generator when the piston machine is operative, a valve means between said reversible feed line and low pressure line connections selectively connecting said servo piston to one of said feed line and said low pressure line or closing the servo piston whereby each of the two connections can be selectively operated as a feed line connection, while the other connection is the low pressure line connection and means connecting said channels to said connections whereby the channel that is located on the side of the rocker body on which the working piston loaded with feed pressure are supported is connected with the source of pressure medium, in which case the pressure medium source is the feed pressure line and at least one servo piston supported against the rocker body on one side of the axis of rotation and positioned at least approximately parallel to the working piston, a counter force generator supported against the rocker body on the other side of the rotation axis, and having at least one additional pressure pocket, which is acted upon by a pressure proportional to the pressure acting on the servo piston and is located on the side of the rocker body on which at least one of the servo piston and the counter force generator is supported against the rocker body.

2. An axial piston machine according to claim 1, in which the servo piston and the counterforce generator are supported on the same side against the rocker body, and wherein only one additional pressure pocket is located on the same side.

3. An axial piston machine according to claim 1, characterized in that the at least one additional pressure pocket is in continuous connection with the feed pressure line

4. An axial piston machine according to claim 1, in which the counterforce generator is a counterforce-generator piston capable of sliding in a counterforce-generator cylinder connected with the feed pressure line, and wherein the at least one additional pressure pocket is connected with the pressure chamber of the counterforce-generator cylinder.

5. An axial piston machine according to claim 4, characterized in that the connection is formed by a borehole in the piston rod of the counterforce-generator piston and a borehole in the rocker body communicating with it.

6. An axial piston machine according to claim 1, in which the servo piston is supported against the rocker body on one side and the counterforce generator is supported on the other side, and wherein an additional pressure pocket is located on each of these two sides of the rocker body.

7. An axial piston machine according to claim 6, wherein the two additional pressure pockets are connected with each other.

8. An axial piston machine according to claim 6, characterized in that the additional pressure pocket is connected with the pressure pocket on the other side.

9. An axial piston machine according to one of claims 7 or 8, characterized in that the connection is formed by a transverse borehole in the rocker body.

10. An axial piston machine according to one of claims 7 or 8, characterized in that the connection is formed by a transverse borehole in the bearing body, against which the rocker body is supported.

* * * * *

UNITED STATES PATENT AND TRADEMARK OFFICE

CERTIFICATE OF CORRECTION

PATENT NO. : 4,543,876

DATED : October 1, 1985

INVENTOR(S) : WALTER HEYL, THOMAS LOFFLER

It is certified that error appears in the above-identified patent and that said Letters Patent is hereby corrected as shown below:

Column 4, line 49, after "body" insert --3--.

Column 5, line 8, after "32" insert --.--.

Signed and Sealed this

*Twenty-fourth* Day of *December 1985*

[SEAL]

*Attest:*

DONALD J. QUIGG

*Attesting Officer*

*Commissioner of Patents and Trademarks*